US010101117B2

(12) United States Patent
Matthews et al.

(10) Patent No.: US 10,101,117 B2
(45) Date of Patent: Oct. 16, 2018

(54) FIREARM MAGAZINE BAND

(71) Applicant: Mag-Band Systems, LLC, Sherwood, AR (US)

(72) Inventors: James Patrick Matthews, Little Rock, AR (US); Paul H. Dillon, Sherwood, AR (US); Karl F. Goshen, North Little Rock, AR (US)

(73) Assignee: Mag-Band Systems, LLC, Sherwood, AR (US)

( * ) Notice: Subject to any disclaimer, the term of this patent is extended or adjusted under 35 U.S.C. 154(b) by 0 days.

(21) Appl. No.: 15/617,701

(22) Filed: Jun. 8, 2017

(65) Prior Publication Data

US 2017/0363386 A1 Dec. 21, 2017

Related U.S. Application Data

(63) Continuation-in-part of application No. 15/073,904, filed on Mar. 18, 2016, now abandoned.

(60) Provisional application No. 62/134,996, filed on Mar. 18, 2015.

(51) Int. Cl.

| | |
|---|---|
| ***F41C 27/00*** | (2006.01) |
| ***F41A 9/65*** | (2006.01) |
| ***F41A 17/34*** | (2006.01) |

(52) U.S. Cl.

CPC ..... *F41C 27/00* (2013.01); *F41A 9/65* (2013.01); *F41A 17/34* (2013.01)

(58) Field of Classification Search

CPC ..... F41C 27/00; F41A 9/65

See application file for complete search history.

(56) References Cited

U.S. PATENT DOCUMENTS

| | | | | |
|---|---|---|---|---|
| 5,526,600 | A * | 6/1996 | Chesnut | F41A 9/65 42/50 |
| 8,485,405 | B2 * | 7/2013 | Crye | F41A 9/65 224/251 |
| 8,793,914 | B2 * | 8/2014 | Anderson | F41A 9/65 42/49.01 |
| 9,459,072 | B2 * | 10/2016 | Kafer | F41C 23/16 |
| 2004/0200111 | A1 * | 10/2004 | Horn | A45F 5/00 42/50 |

OTHER PUBLICATIONS

Mako Group Black/OD Green Magazine Well Grip for M-16 / M4 / AR-15—2 options, https://www.opticsplanet.com/mako-group-black-od-green-magazine-well-grip-for-m-16-m4-ar-15.html (Year: 2015).*

(Continued)

*Primary Examiner* — Stephen Johnson

(74) *Attorney, Agent, or Firm* — Joe D. Calhoun

(57) ABSTRACT

A magazine identifier is provided. The magazine identifier is an endless band having a front surface, a rear surface, a first side surface, a second side surface, an inner surface, an upper rim and a lower rim. The endless band is formed of a material with rubber elasticity. For example, the endless band may be made of natural rubber, synthetic rubber, silicone or any material with a similar elasticity to rubber. The endless band is placed over a magazine of a firearm to identify the type of ammunition carried within the magazine and the owner of the magazine.

20 Claims, 18 Drawing Sheets

(56) References Cited

OTHER PUBLICATIONS

Easy magazine ID bands $10.95/5. New 5.56 Bands—300BlkTalk, http://www.300blktalk.com/forum/viewtopic.php?t=87555 (Year: 2014).*
Guerrilla Grip—3 Pack, http://guerrillaworxrd.com/?product=guerrilla-grip-3-pack (Year: 2015).*
"Easy magazine ID bands $10.95/5. New 5.56 Bands", 300BlkTalk, http://www.300blktalk.com/forum/viewtopic.php?t=87555, pp. 1-10, (Year: 2014).*

* cited by examiner

FIG. 1
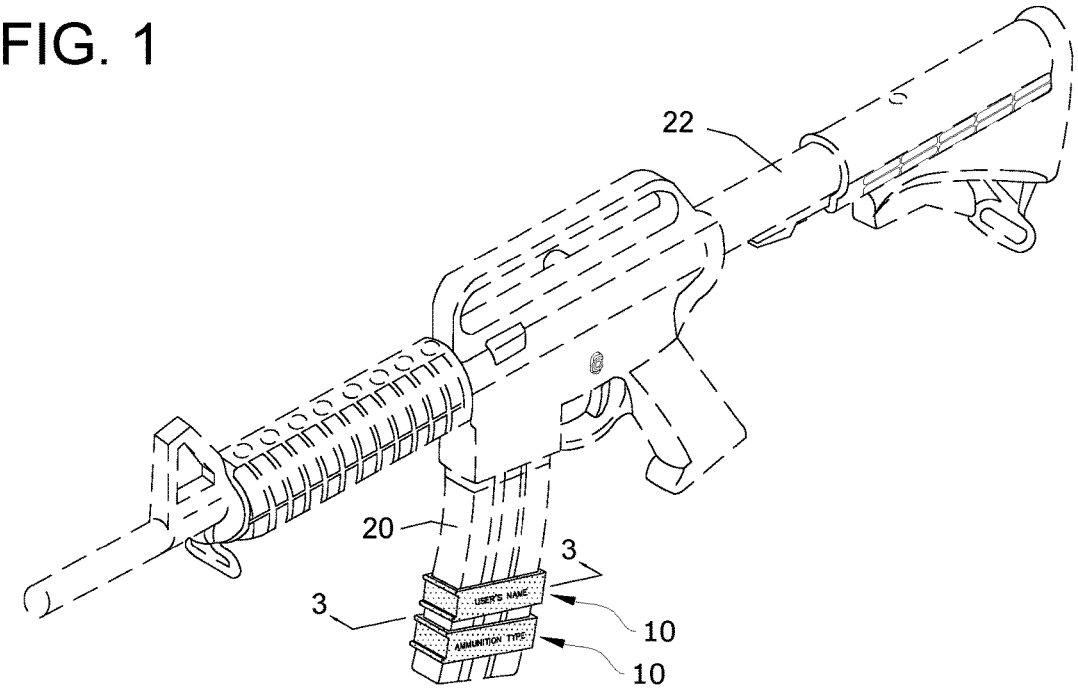
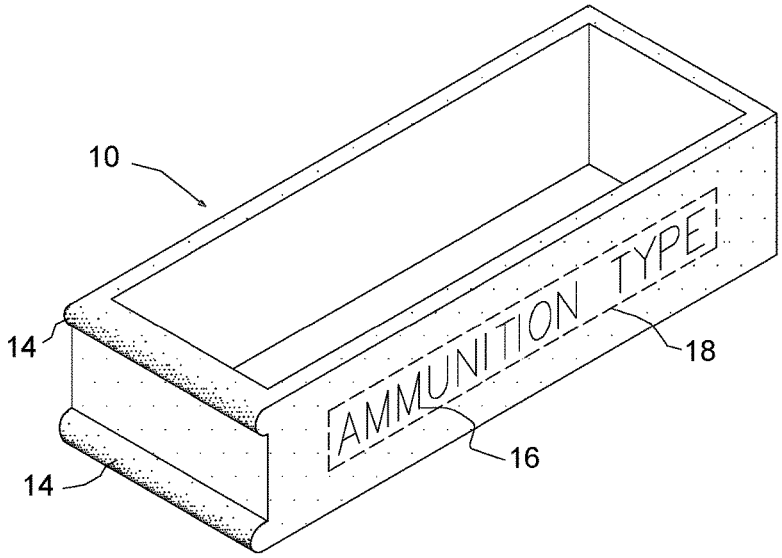
FIG. 2

FIG. 3
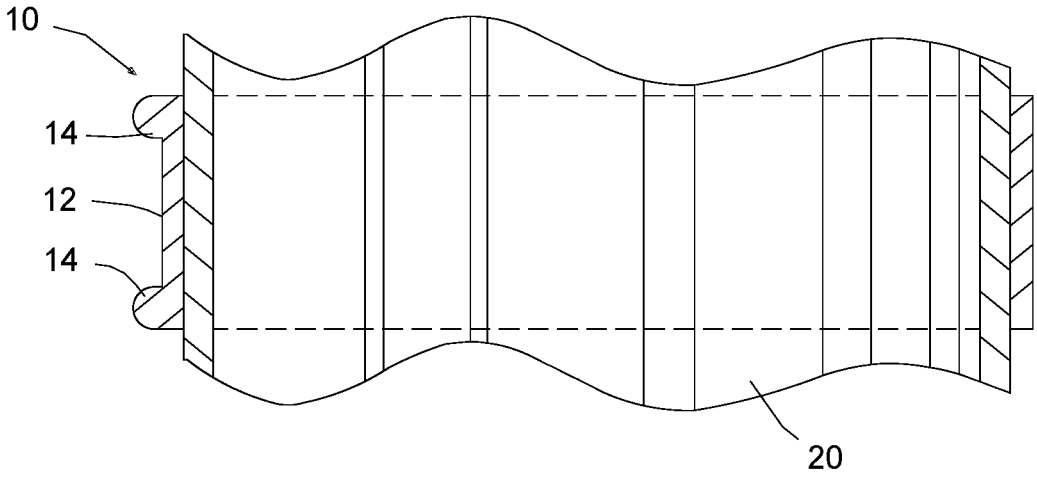
FIG. 4
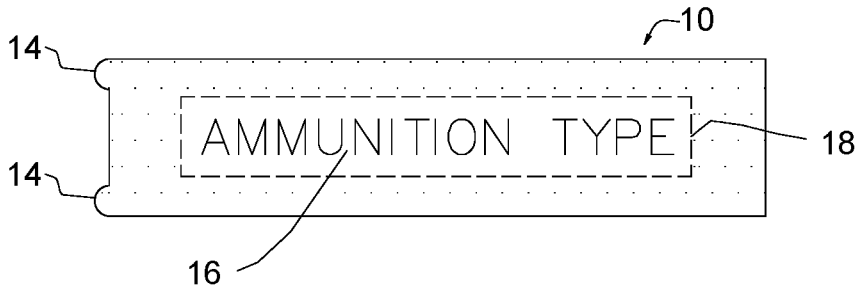
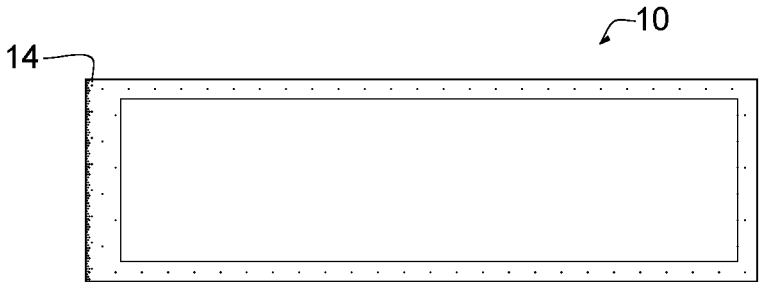
FIG. 5

FIREARM MAGAZINE BAND

CROSS-REFERENCE TO RELATED APPLICATION

This application is a continuation-in-part application claiming claims the benefit of priority of co-pending U.S. utility patent application Ser. No. 15/073,904 filed Mar. 18, 2016, which claims the benefit of U.S. provisional application No. 62/134,996, filed Mar. 18, 2015, the contents of both of which are herein incorporated by reference.

BACKGROUND OF THE INVENTION

The present invention relates to firearm magazines and, more particularly, to a stretchable band used to identify types of ammunition loaded in the magazine and used to identify the owner of the firearm magazine.

Ammunition magazines for rifles or other long arms often appear to be virtually identical. Unmarked or inadequately marked ammunition magazines left in storage or when used at a firing range, or when actually used in the field, can lead to misidentification of the load in the magazine and/or the owner of the magazine. This may result in tragic or even fatal consequences, such as when the magazine contains ammunition that my damage or even destroy the barrel, and injure or kill the firearm user. Many identical rifle magazines can be loaded with several different types of ammunition. This has lead to many firearms accidents, caused by having the wrong ammunition in the magazine. As documented by the National Rifle Association, firing the wrong ammunition in a rifle could result in injury or death to the operator and/or bystanders. https://www.nrablog.com/articles/2016/9/avoiding-the-300blk-ar15-kaboom/.

Also many firearms with suppressors attached require sub-sonic ammunition in order to keep the sound level low enough so as to not need hearing protection. Sub-sonic ammunition, once loaded in the magazine, looks identical to super-sonic ammunition. At this date and time, once a magazine is loaded, the common way to know what ammunition is in the magazine and who owns the magazine is to use colored tape, or to put a colored mark on the magazine base plate, or to employ homemade stickers, markings using colored ink or pencil, and similar improvisational systems that can either be easily removed or marked over, fall off, not be seen from the side of the magazine, or unaccountably disappear and leave a debris-catching residue on the magazine.

As can be seen, there is a need for an improvement in identifying the type of ammunition in a firearm magazine and the owner of that magazine.

SUMMARY OF THE INVENTION

In one aspect of the present invention, a magazine identifier comprises: an endless band, made in a shape having a rectangular cross-section that matches the shape of a rifle ammunition magazine, comprising a front surface, a rear surface, a first side surface, a second side surface, an inner surface, an upper rim and a lower rim, wherein the endless band is formed of a material comprising a rubber elasticity; a first ridge and a second ridge protrude from the front surface forming a finger groove in between, that allows the user of the magazine to grip the magazine better and use the placement of multiple bands on the magazine as a way to create an adjustable grip to fit the user's individual size hands or gripping style.

In another aspect of the present invention, a magazine identifier comprises: an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a material comprising a rubber elasticity; text is disposed on the first side surface and/or the second side surface, and the pre-printed or personally inscribed text comprises an ammunition type.

In another aspect of the present invention, a magazine identifier comprises: an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a material comprising a rubber elasticity; and a specially designed system of bumps, and/or ridges that protrude from the band, located on the side(s) of the band helping the user of the magazine to determine what type of ammunition is loaded in the magazine by touching the protuberance(s) on the band and without having to look at the magazine band. This is meant to be used in low light to no light conditions.

In another aspect of the present invention, a method of identifying a magazine comprises: providing an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a material comprising a rubber elasticity; and wrapping the endless band around the magazine of a firearm. Included is a writable, non-reflective strip on one or both sides of the band, where the user can note the ammunition load in the magazine, the caliber of bullet in the magazine and/or the name of the owner of the magazine.

In another aspect of the present invention, a magazine identifier comprises: an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a rubber elasticity; it is also produced in multiple colors, such as but (not limited to) red, blue, black, white, grey, green, pink and the like (and combinations thereof), to help the user easily identify his or her magazine from other rifle owners' magazines.

In another aspect of the present invention, a magazine identifier comprises: an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a rubber elasticity; by placing multiple bands on the magazine, the bands are specially designed to protect the magazine from dents and scratches, caused by daily use of the magazine and dropping the magazine.

In another aspect of the present invention, a magazine identifier comprises: an endless band, made in a shape having a rectangular cross-section that matches the shape of a rifle magazine, comprising a front surface, a rear surface, a first side surface, a second side surface, an inner surface, an upper rim and a lower rim, wherein the endless band is formed of a rubber elasticity; it is designed of non-reflective material or surface coating to cut eliminate or reduce reflective glare that often occurs from metal magazines. After metal magazines are used often and/or thrown to the ground during training or other exercises, the coating or other finish on the magazine wears off and exposes the silver color of the metal; the same occurs whenever contact with the ground scratches the magazine. The bands reduce the wear and tear on the magazines bluing, that will wear off over time and use, making the magazine shiny in appearance. The band may also be used to cover reflective areas that have already appeared on the magazine.

These and other features, aspects and advantages of the present invention will become better understood with reference to the following drawings, description and claims.

BRIEF DESCRIPTION OF THE DRAWINGS

FIG. 1 is a perspective view of a representative sample of an embodiment of the present invention in use.

FIG. 2 is a perspective view of the embodiment of the invention depicted in FIG. 1.

FIG. 3 is a section view thereof, sectioned at plane 3-3 in FIG. 1.

FIG. 4 is a side elevation view thereof.

FIG. 5 is a top plan view thereof.

DETAILED DESCRIPTION OF THE INVENTION

Figure 6:
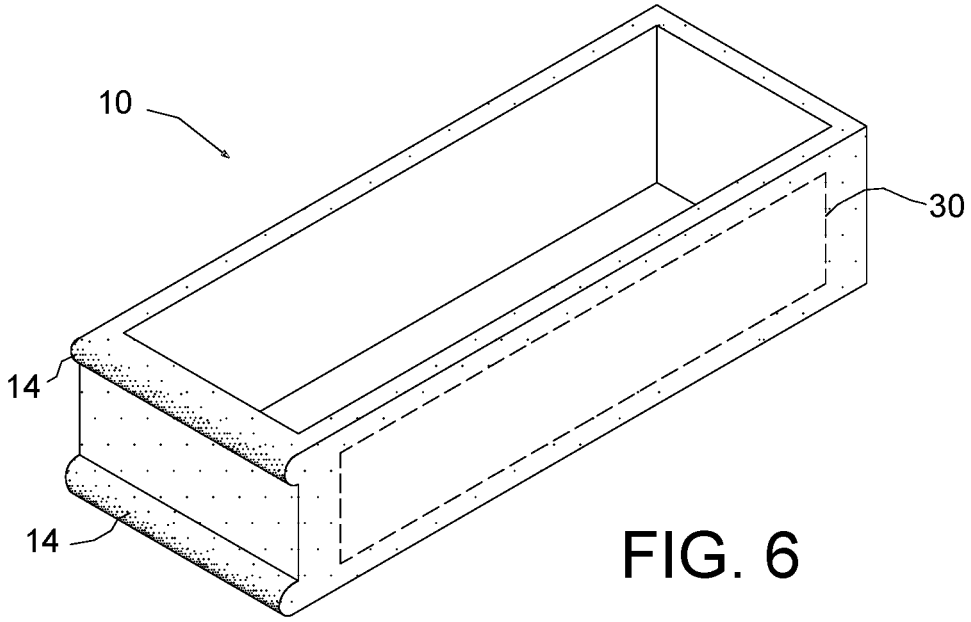
FIG. 6 is a perspective view of a representative sample of another embodiment of the present invention, having a larger writing area.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a heavy duty, stretchable band made in a shape having a rectangular cross-section that matches the cross-section of the rifle magazine around which it is stretched. Once the band is stretched around the magazine, the interior corners of the band contract into adjoining relationship with the magazine, leaving no space between the two. Besides providing a tighter grip on the magazine (than provided by conventional circular bands), the lack of spaces prevents sand and other grit or debris from lodging between the band and magazine to deface the magazine or contribute to malfunctioning.

Multiple bands are spaced around a magazine in a way to fit the particular user's hand or gripping style. The band is used to identify the type of ammunition the magazine carries and/or the owner of the magazine. The separation between the bands (if any) may enable user of the magazine to have a customized grip on the magazine, to fit his or her hand size. The bands may also provide a way to protect the magazine from being damaged by impact such as when, after being discarded on the ground during reloading with another magazine, another user or other moving body compresses the discarded magazine into the ground. The band also could muffle the sound of a magazine being dropped during a reload or by accident; this may have life saving significance in combat situations.

The present invention includes an easy to write on, durable, rubber or silicone elastic band appropriately marked with hand written or pre-printed markings, and/or using bumps, ridges or other protuberances on one or more of the sides. The protuberance(s) may be of any dimensions enabling the user to identify the magazine to discern the type of ammunition within, preferably without visual identification. More preferably the protuberances will enable such identification while the user is wearing gloves.

Although the bands are placed on an ammunition magazine to prevent confusion as to the contents of the magazine and/or the owner of the magazine, the bands also function to provide an adjustable grip for several purposes. The bands may be spaced or positioned by the user to accommodate the size of the user's fingers and/or hands, and/or to accommodate the manner in which the user prefers to grip the magazine (from fingers together to fingers splayed far apart). Unlike any other known devices, this adjustability has enhanced utility for users who prefer to grip the magazine while firing the firearm, such as after the barrel (and associated hand grip stock) becomes hot from repeated firing. The positioning of the bands also facilitates gripping the magazine for removal of the magazine for reloading.

Since many ammunition types and calibers may be loaded in the same magazine, the present invention provides a superior identification method that improves the safety of rifle operation by reducing the possibility of firing the wrong ammunition in a rifle. Firing the wrong ammunition in a rifle could result in injury or death to the operator and/or bystanders.

Referring to FIGS. 1 through 13, the present invention includes a magazine identifier. The magazine identifier is an endless band, made in a shape having a rectangular cross-section that matches the shape of a rifle magazine (20) having a front surface, a rear surface, a first side surface, a second side surface, an inner surface, an upper rim and a lower rim. The endless band (10) is formed of a material with rubber elasticity. For example, the endless band may be made of natural rubber, synthetic rubber, silicone or any material with a similar elasticity to rubber. The endless band (10) is placed over a magazine (20) of a firearm (22) to identify the type of ammunition carried within the magazine (20).

The endless band (10) may identify the type of ammunition using different methods. For example, text (16) indicating the type of ammunition may be printed on the first side surface, the second side surface or both. In certain embodiments, the first side surface, the second side surface or both may include a writeable surface (30) in which a user may write on the endless band (10) using a pen or marker. In certain embodiments, a plurality of endless bands (10) may each include different colors, thereby identifying the type of ammunition and/or the owner of the magazine. In other embodiments the endless band may contain ridges or round bumps located on one or both sides of the band, to provide a tactile way of identifying the type of ammunition loaded in the magazine.

The endless band (10) of the present invention may further include one or more ridges (14) forming a finger groove in between. For example, a first ridge (14) and a second ridge (14) protrude from the front surface. The first ridge (14) and the second ridge (14) may be substantially parallel relative to one another. The first ridge (14) may protrude from the front surface extending from the upper rim, and the second ridge (14) may protrude from the front surface extending from the lower rim. The finger grooves allow users to easily grip the magazine (20). For example, as illustrated in FIG. 1, a plurality of endless bands (10) may form a plurality of finger grooves, allowing a user to easily grasp the magazine (20).

In certain embodiments, the endless band (10) includes a textured surface (12). The textured surface (12) adds additional grip to the magazine (20) when the elastic bands (10) are placed on the magazine (20). The textured surface (12) may be disposed on the front surface, rear surface, and first side surface and/or second side surface. The textured surface (12) may thereby be placed all over the elastic band (10) except for the inner surface (11) and/or the writing surface (18). The writing surface (18) and/or the inner surface (11) may be smooth.

The present invention may further include a method of identifying a magazine (20). The method may include the following steps: providing an endless band (10), made in a shape having a rectangular cross-section that matches the shape of a rifle magazine (20), comprising a front surface, a rear surface, a first side surface, a second side surface, an inner surface, an upper rim and a lower rim, wherein the endless band (10) is formed of a material comprising a rubber elasticity; wrapping the endless band (10) around the magazine (20) of a firearm (22); and printing text (16) on the first side surface and/or the second side surface, wherein the text (16) comprises an ammunition type of the magazine and/or an identification of the owner of the magazine.

Figure 7:
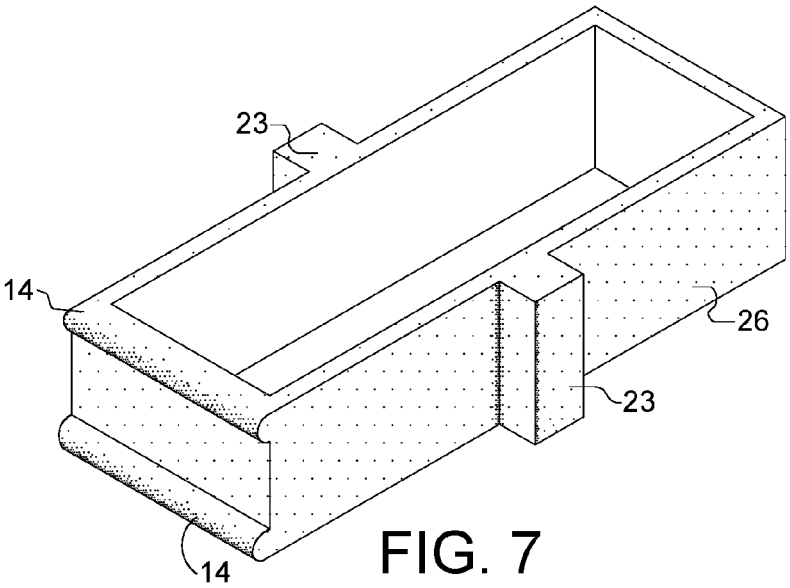
FIG. 7 is a perspective view of a representative sample of another embodiment of the present invention showing a vertical side ridge used for tactile identification of the contents of the magazine.
Figure 8:
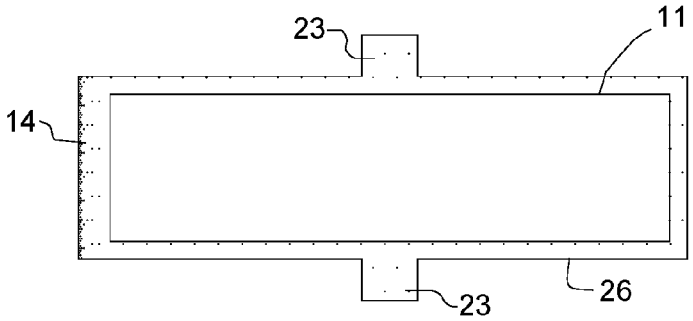
FIG. 8 is a top plan view thereof; the bottom plan view is a mirror image.
Figure 9:
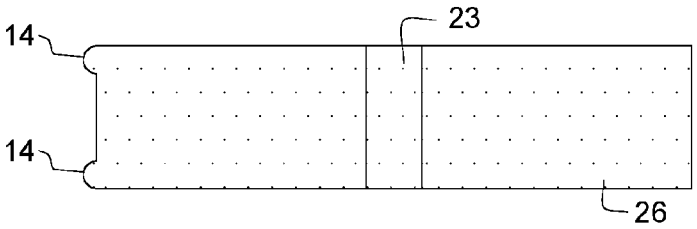
FIG. 9 is a side elevation view thereof.
Figure 10:
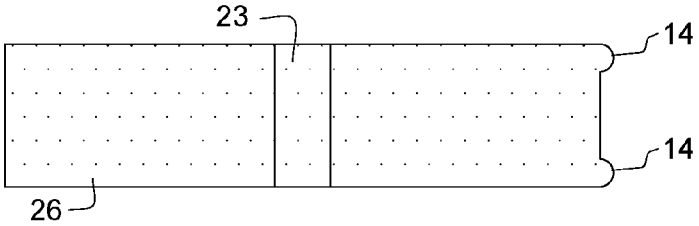
FIG. 10 is an opposite side elevation view thereof.
Figure 11:
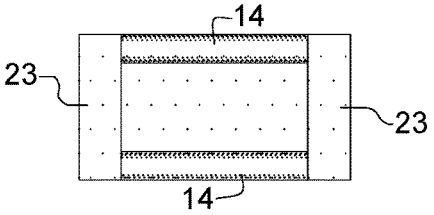
FIG. 11 is a front elevation view thereof.
Figure 12:
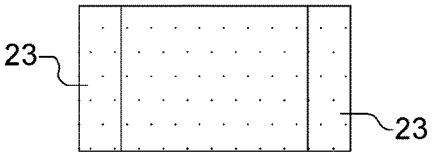
FIG. 12 is a rear elevation view thereof.
Figure 13:
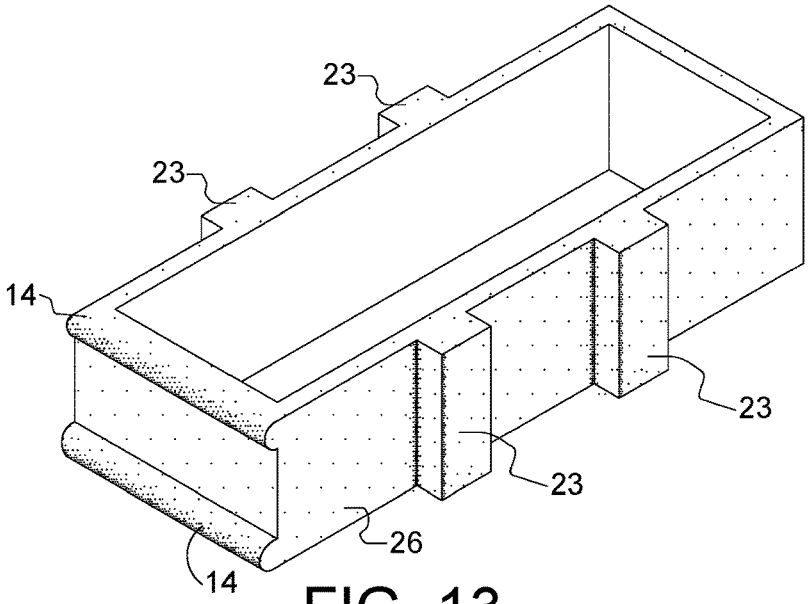
FIG. 13 is a perspective view of a representative sample of another embodiment of the present invention showing two vertical side ridges used for tactile identification of the contents of the magazine.
Figure 14:
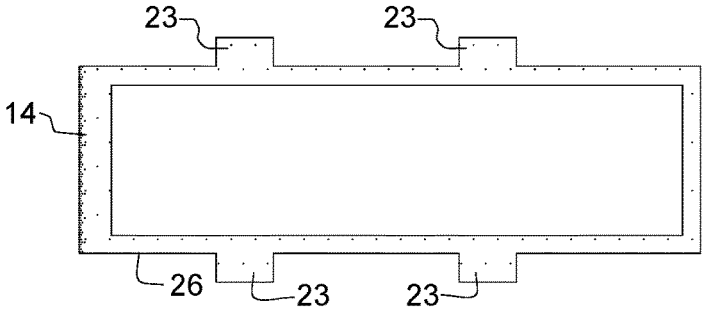
FIG. 14 is a top plan view thereof; the bottom plan view is a mirror image.
Figure 15:
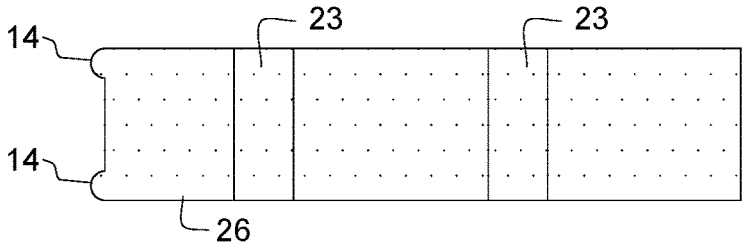
FIG. 15 is a side elevation view thereof.
Figure 16:
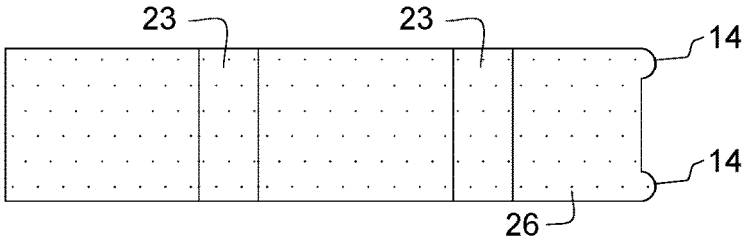
FIG. 16 is an opposite side elevation view thereof.
Figure 17:
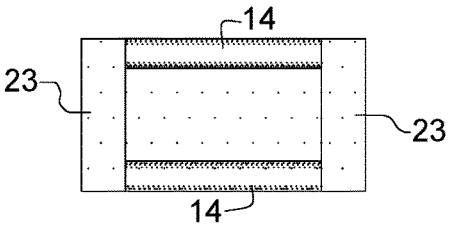
FIG. 17 is a front elevation view thereof.
Figure 18:
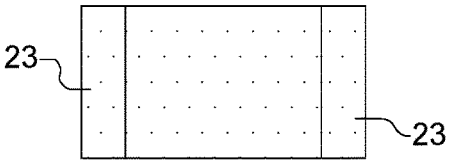
FIG. 18 is a rear elevation view thereof.
Figure 19:
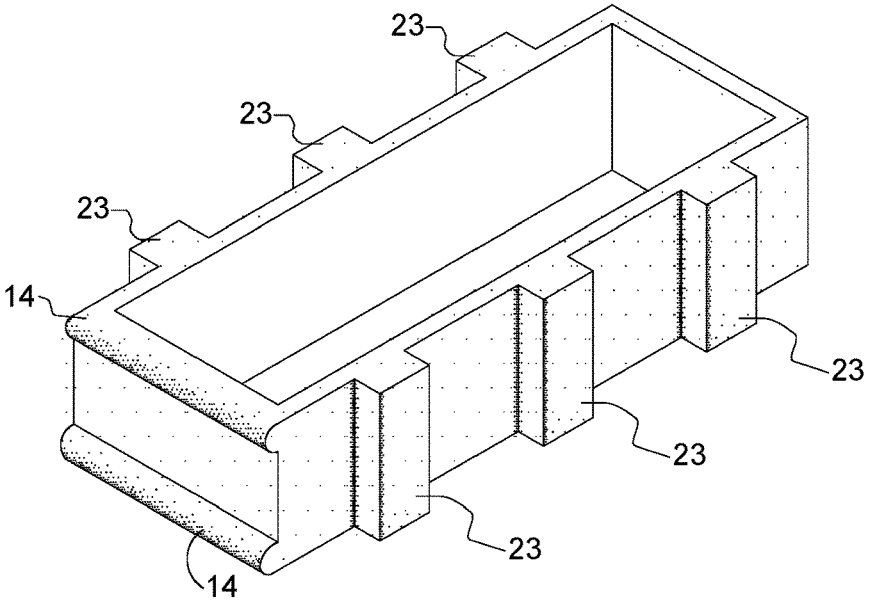
FIG. 19 is a perspective view of a representative sample of another embodiment of the present invention showing three side ridges used for tactile identification of the contents of the magazine.
Figure 20:
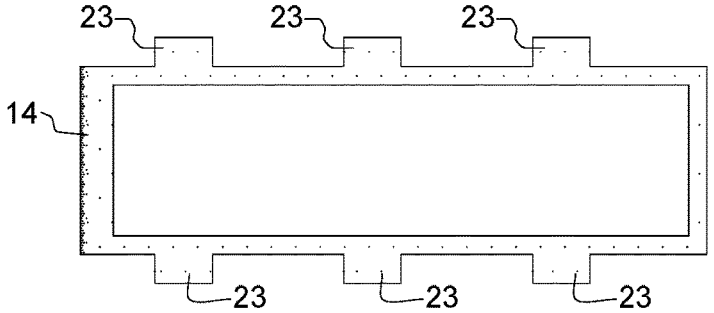
FIG. 20 is a top plan view thereof; the bottom plan view is a mirror image.
Figure 21:
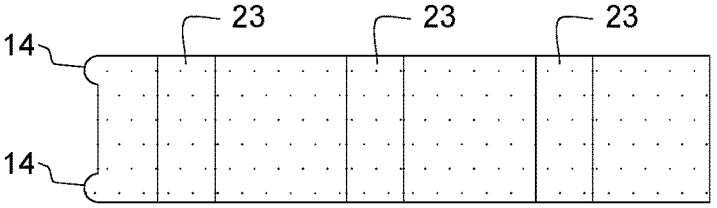
FIG. 21 is a side elevation view thereof.
Figure 22:
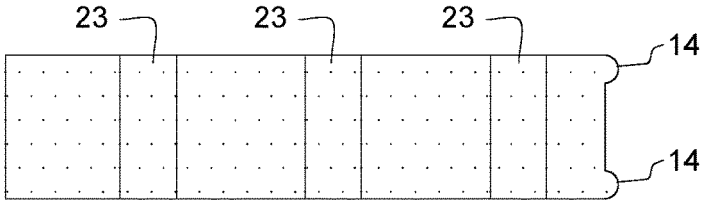
FIG. 22 is an opposite side elevation view thereof.
Figure 23:
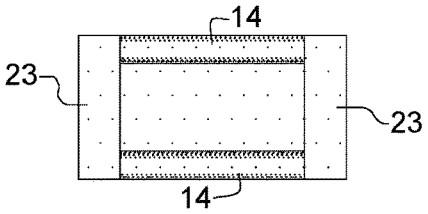
FIG. 23 is a front elevation view thereof.
Figure 24:
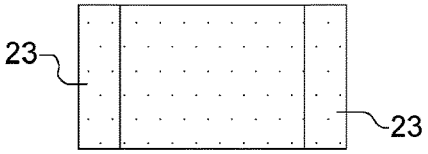
FIG. 24 is a rear elevation view thereof.
Figure 25:
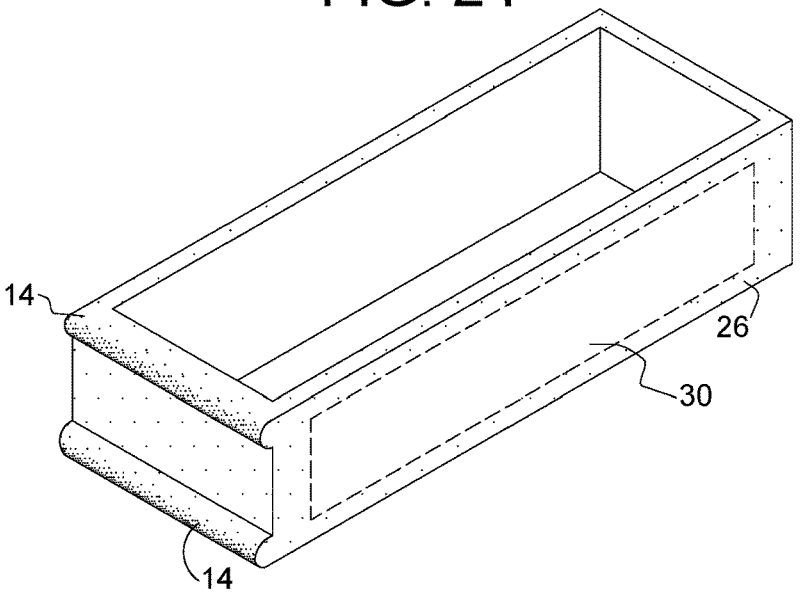
FIG. 25 is a perspective view of a representative sample of another embodiment of the present invention showing a larger writing area for labeling.
Figure 26:
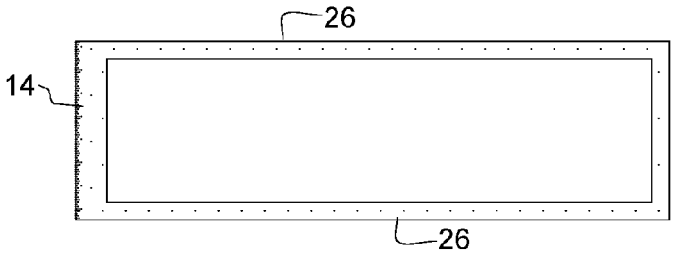
FIG. 26 is a top plan view thereof; the bottom plan view is a mirror image.
Figure 27:
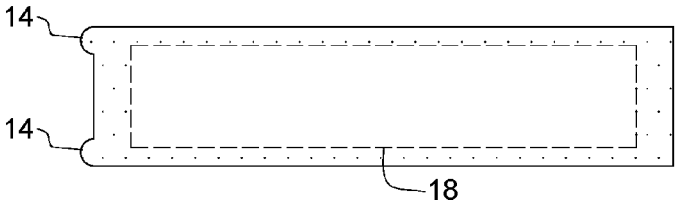
FIG. 27 is a side elevation view thereof.
Figure 28:
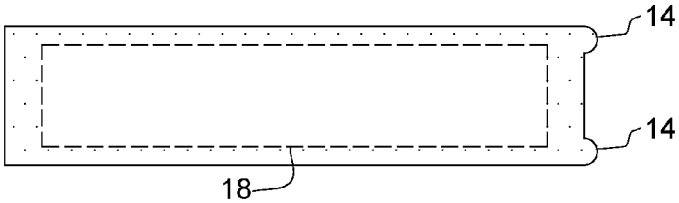
FIG. 28 is an opposite side elevation view thereof.
Figure 29:
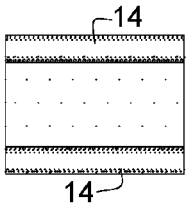
FIG. 29 is a front elevation view thereof.
Figure 30:
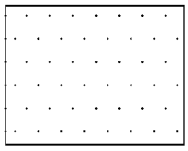
FIG. 30 is a rear elevation view thereof.
Figure 31:
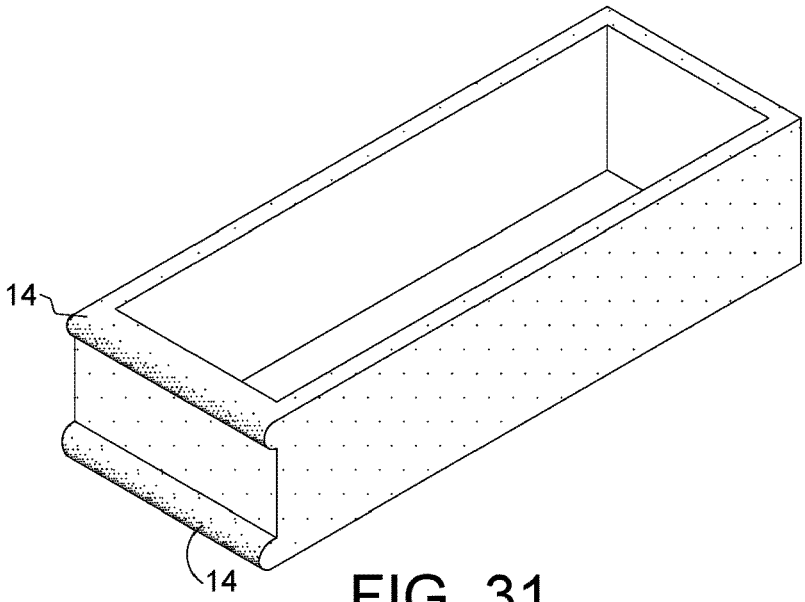
FIG. 31 is a perspective view of a representative sample of another embodiment of the present invention, the stippling on the flat surface depicting a textured and/or non-reflective surface without any writing area.
Figure 32:
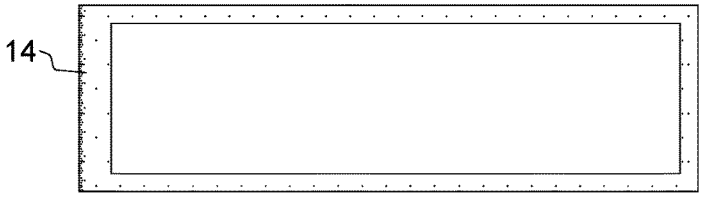
FIG. 32 is a top plan view thereof; the bottom plan view is a mirror image.
Figure 33:
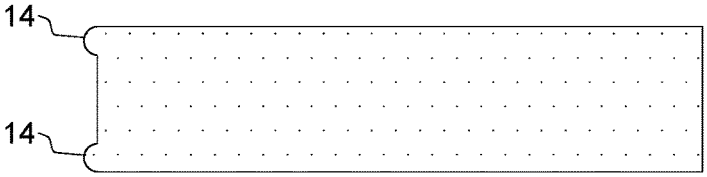
FIG. 33 is a side elevation view thereof.
Figure 34:
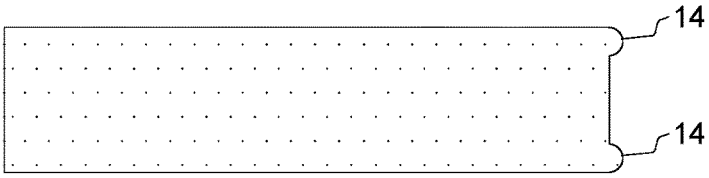
FIG. 34 is an opposite side elevation view thereof.
Figure 35:
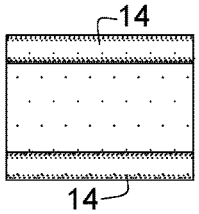
FIG. 35 is a front elevation view thereof.
Figure 36:
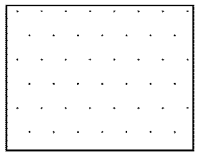
FIG. 36 is a rear elevation view thereof.

As depicted in FIG. 7, one embodiment may include a single vertical ridge (23) on one or both sides (26) of the band, for tactile identification purposes. The exterior of the band may be covered with non-reflective coating, and/or have a textured finish that eliminates or reduces reflection. As depicted in FIG. 13, another embodiment may include two vertical ridges (23) on one or both sides (26) of the band, for tactile identification purposes, with the same non-reflective surface treatment. The same goes for the embodiment depicted in FIG. 19 having three vertical ridges (23).

Figure 37:
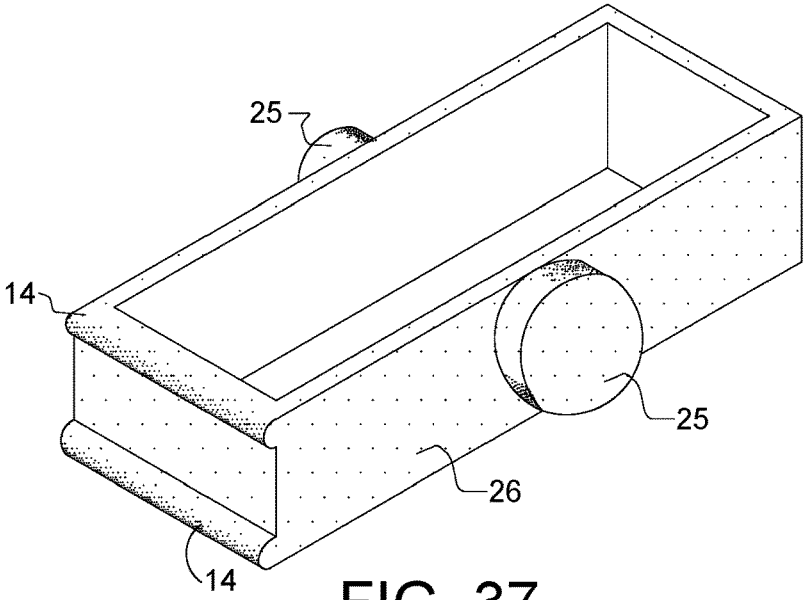
FIG. 37 is a perspective view of a representative sample of another embodiment of the present invention showing a button-like protuberance used for tactile identification of the contents of the magazine.
Figure 38:
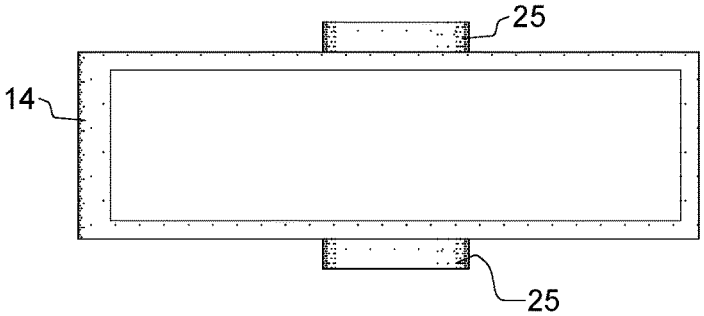
FIG. 38 is a top plan view thereof; the bottom plan view is a mirror image.
Figure 39:
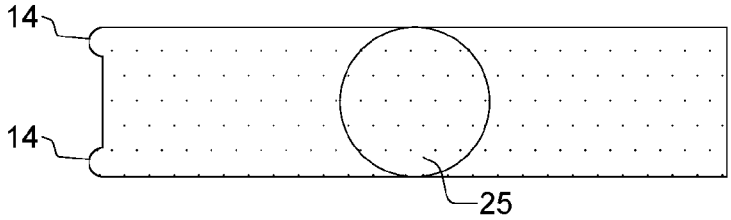
FIG. 39 is a side elevation view thereof.
Figure 40:
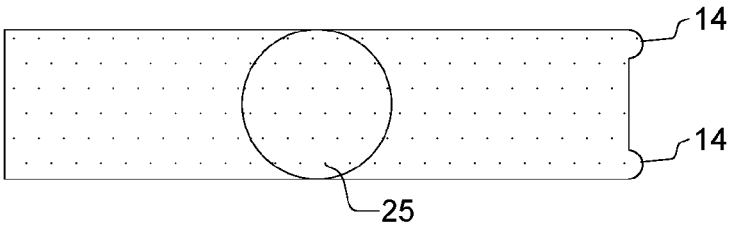
FIG. 40 is an opposite side elevation view thereof.
Figure 41:
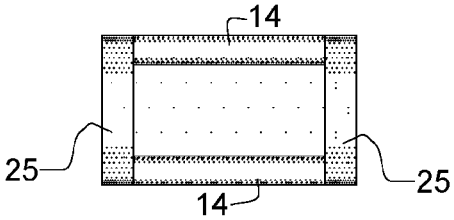
FIG. 41 is a front elevation thereof.
Figure 42:
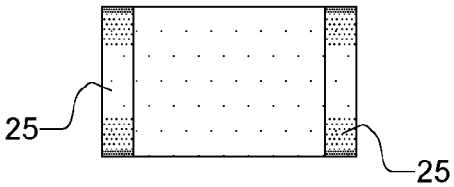
FIG. 42 is a rear elevation view thereof.
Figure 43:
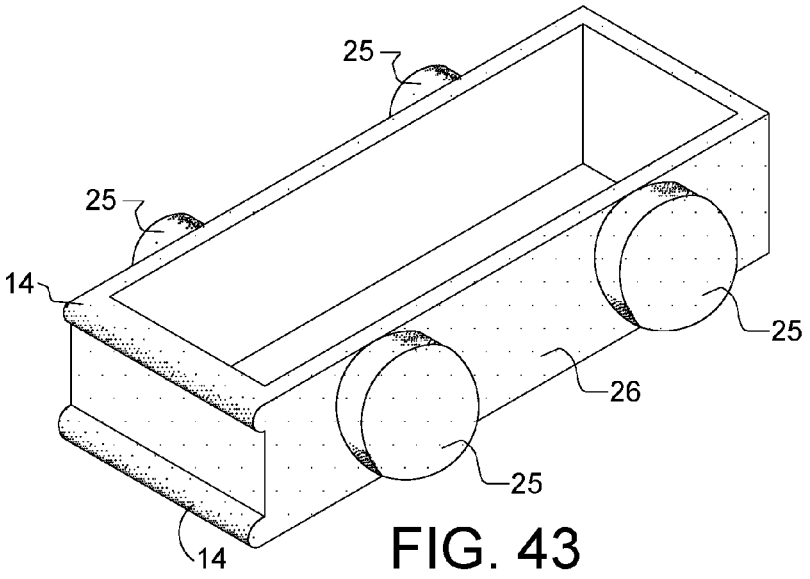
FIG. 43 is a perspective view of a representative sample of another embodiment of the present invention showing two button-like protuberances used for tactile identification of the contents of the magazine.
Figure 44:
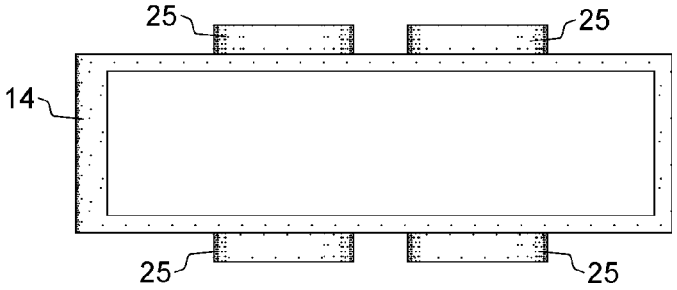
FIG. 44 is a top plan view thereof; the bottom plan view is a mirror image.
Figure 45:
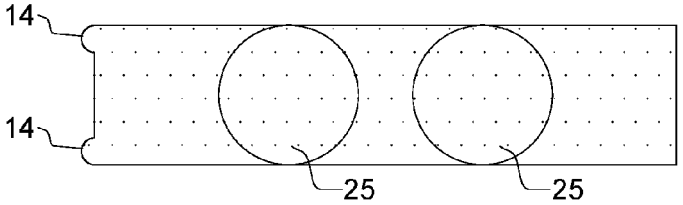
FIG. 45 is a side elevation view thereof.
Figure 46:
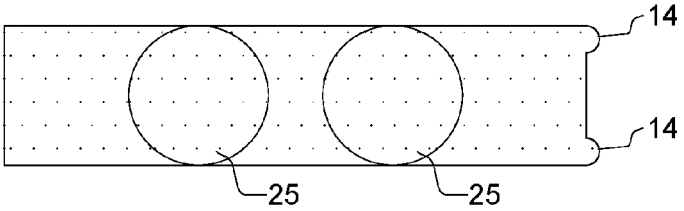
FIG. 46 is an opposite side elevation view thereof.
Figure 47:
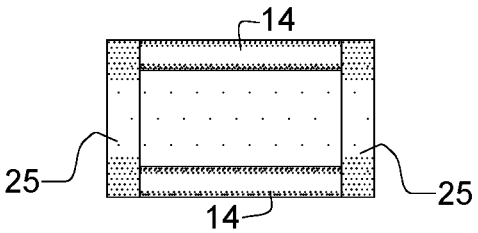
FIG. 47 is a front elevation view thereof.
Figure 48:
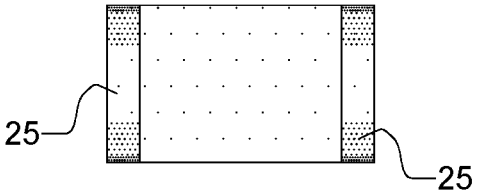
FIG. 48 is a rear elevation view thereof.
Figure 49:
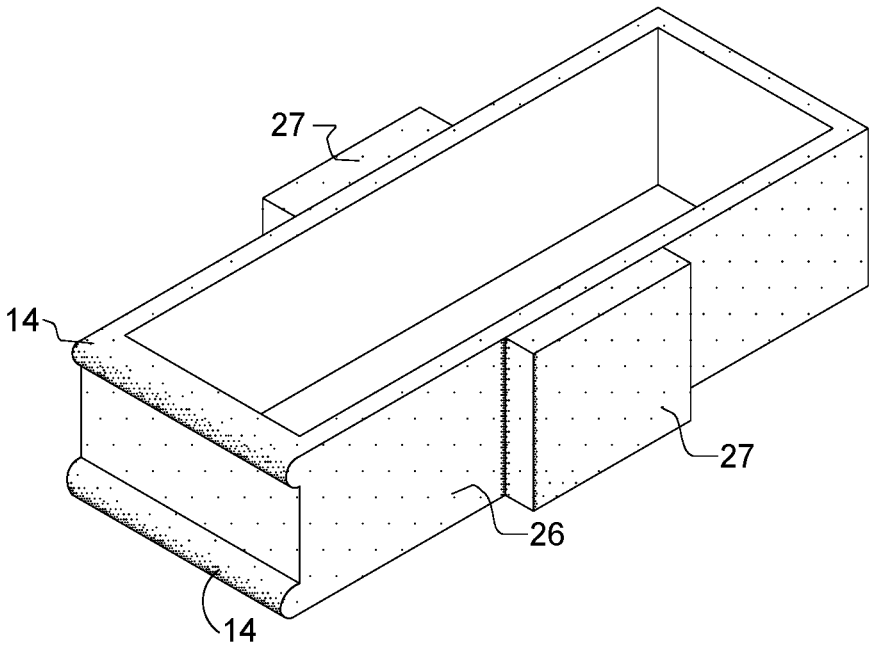
FIG. 49 is a perspective view of a representative sample of another embodiment of the present invention showing a block-like protuberance (27) used for tactile identification of the contents of the magazine.
Figure 50:
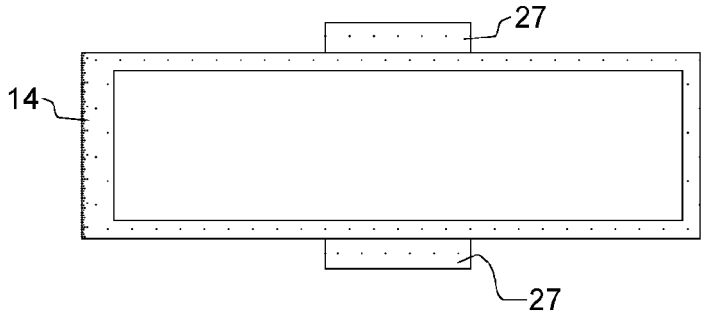
FIG. 50 is a top plan view thereof; the bottom plan view is a mirror image.
Figure 51:
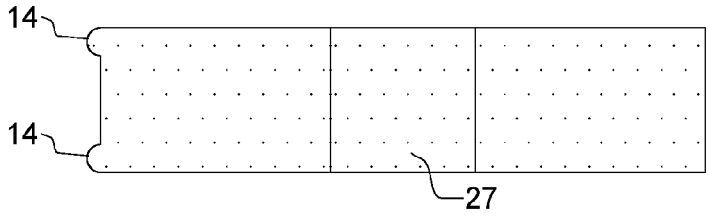
FIG. 51 is a side elevation view thereof.
Figure 52:
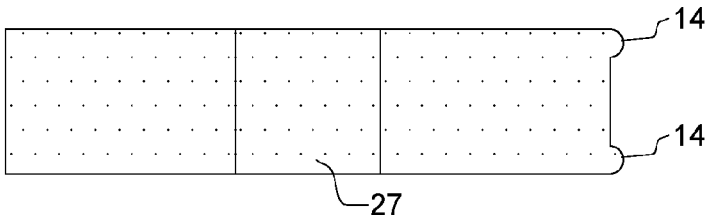
FIG. 52 is an opposite side elevation view thereof.
Figure 53:
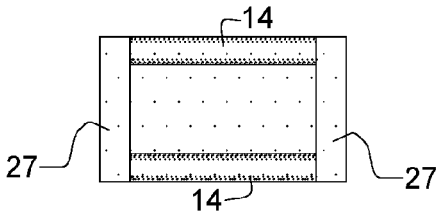
FIG. 53 is a front elevation view thereof.
Figure 54:
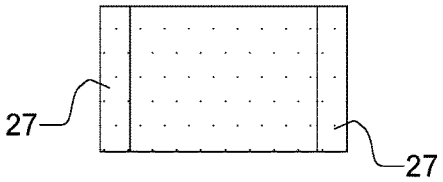
FIG. 54 is a rear elevation view thereof.
Figure 55:
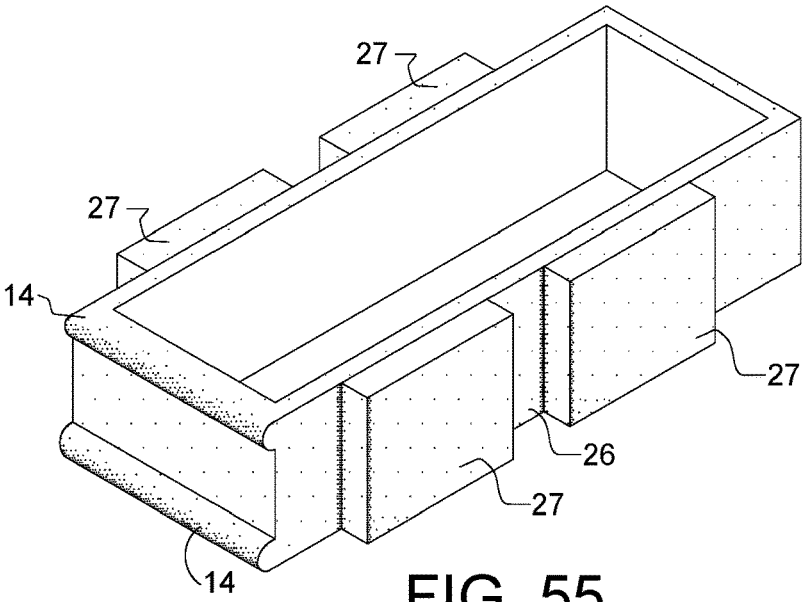
FIG. 55 is a perspective view of a representative sample of another embodiment of the present invention showing two block-like protuberances (27) used for tactile identification of the contents of the magazine.
Figure 56:
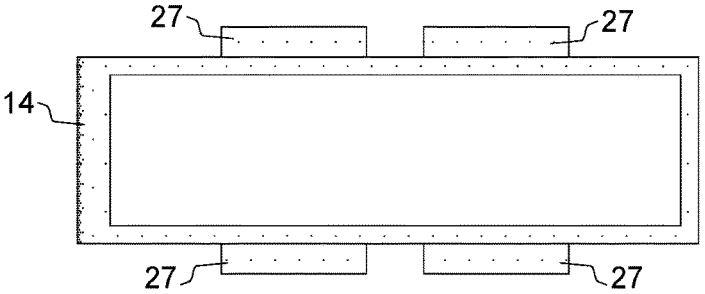
FIG. 56 is a top plan view thereof; the bottom plan view is a mirror image.
Figure 57:
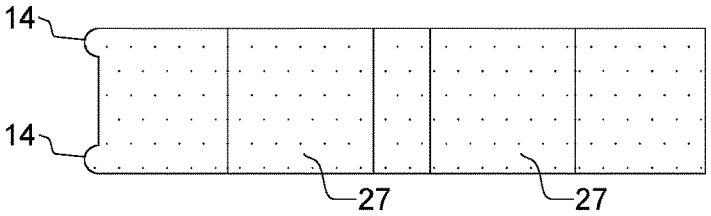
FIG. 57 is a side elevation view thereof.
Figure 58:
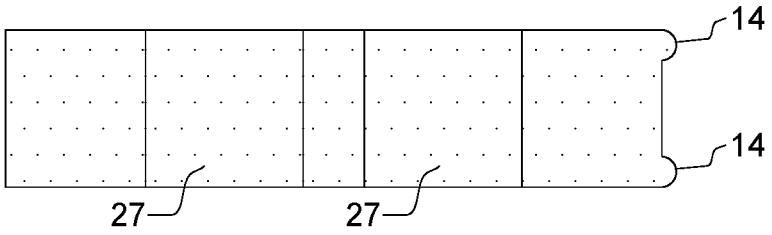
FIG. 58 is an opposite side elevation view thereof.
Figure 59:
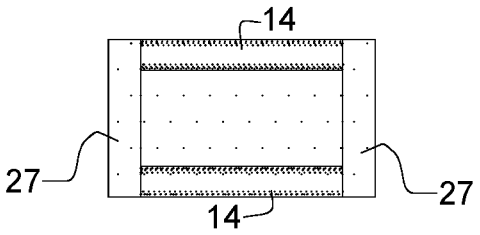
FIG. 59 is a front elevation view thereof.
Figure 60:
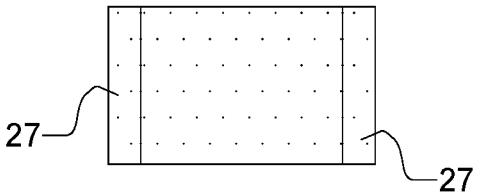
FIG. 60 is a rear elevation view thereof.
Figure 61:
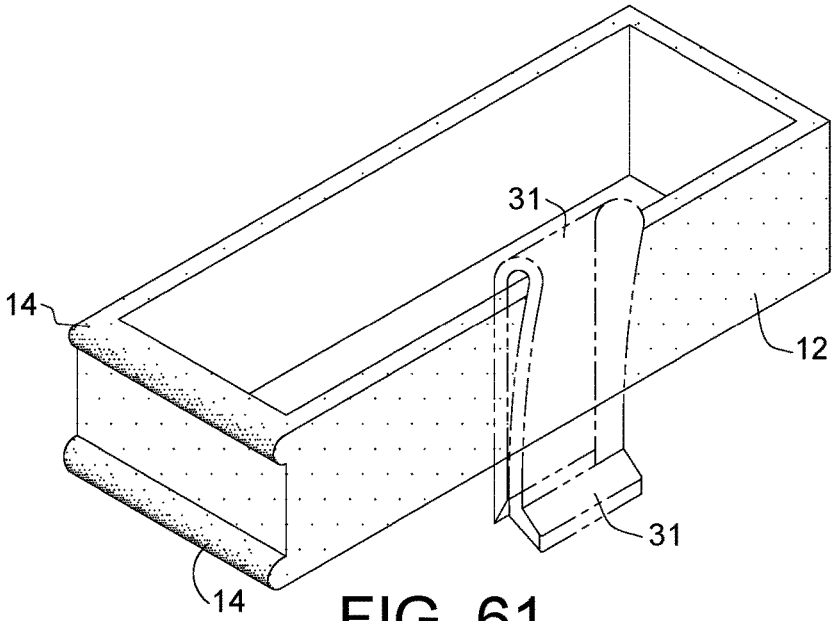
FIG. 61 is a perspective view of a representative sample of another embodiment of the present invention showing a band in use with a belt clip (31).
Figure 62:
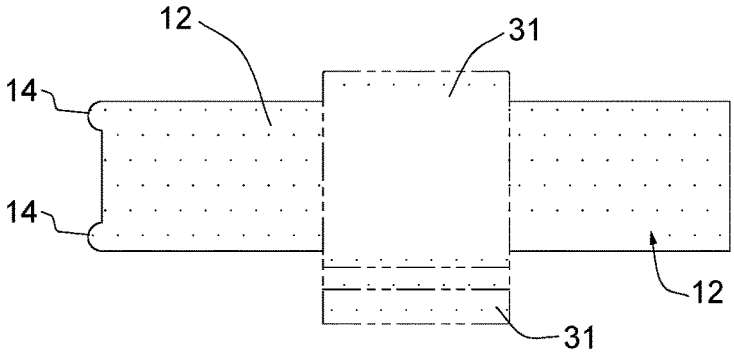
FIG. 62 is a side elevation view thereof.
Figure 63:
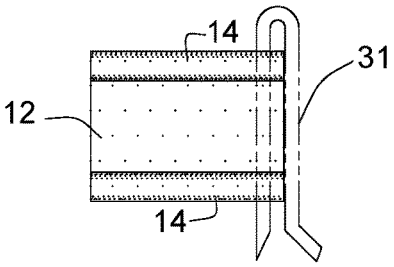
FIG. 63 is a front elevation view thereof.
Figure 64:
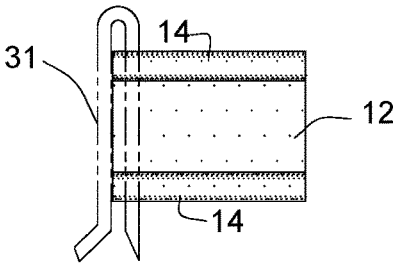
FIG. 64 is another front elevation view thereof, with the clip on the opposite side.

Other protuberances and arrangements thereof providing tactile identification may be included. As depicted in FIG. 37, one embodiment may include a single button-like rounded protuberance on one or both sides of the band, for tactile identification purposes. As depicted in FIG. 43, one embodiment may include two button-like rounded protuberances on one or both sides of the band, for tactile identification purposes. As depicted in FIG. 49, one embodiment may include a square block-like protuberance (27) on one or both sides of the band, for tactile identification purposes. As depicted in FIG. 55, one embodiment may include two block-like protuberances on one or both sides of the band, for tactile identification purposes.

The exterior of the band may also be covered with non-reflective coating, and/or have a textured finish that eliminates or reduces reflection. As depicted in FIG. 43, another embodiment may include two such buttons (25) on one or both sides of the band, for tactile identification purposes, with the same non-reflective surface treatment.

A means of securing the band (and associated magazine) to the user or storage location may also be included. For example, a clip for securing the band (and associated magazine) to a thin panel such as the belt or pocket of a user may be used separately with the band, or it may be attached to or made integral with the band. The same goes for other means for securing the band (and associated magazine) to a location such as the pocket formed on the inside of an automobile door.

Besides the band and band system disclosed herein, the invention further includes the method of using the band or system. Most generally, the method of identifying a magazine may comprise (include) the steps of:

(a) providing an elastomeric band defining a cavity having a rectangular cross-section sized to snugly capture the rifle magazine having corresponding rectangular cross-section dimensions, said band comprising a front surface, a rear surface, a first side surface, a second side surface, an inner surface, an upper rim and a lower rim, wherein a first ridge protrudes from the front surface upper rim and a second ridge protrudes from the front surface lower rim, together forming a finger groove in between;

(b) stretching the band around the magazine; and (c) printing text on one of the first side surface and the second side surface, wherein the text comprises an ammunition type of the magazine. The band may also have one or more protuberances upstanding from one or both sides, for identification purposes.

The method may also include providing a plurality of said bands, each separated to accommodate a separate finger of the user in an arrangement preferred by the user.

It should be understood, of course, that the foregoing relates to exemplary embodiments of the invention and that modifications may be made without departing from the spirit and scope of the invention as set forth in the following claims.

What is claimed is:

1. A magazine identifier band capturing a rifle ammunition magazine inserted therethrough, said magazine identifier band comprising an elastomeric band conforming to the cross-sectional configuration of the rifle ammunition magazine so that said magazine identifier band comprises a front surface, a rear surface, a first side surface, a second side surface, an inner surface, an upper rim and a lower rim, wherein:

(a) a first ridge and a second ridge protrude from the front surface forming a finger groove in between; and (b) at least one of the first side surface and the second side surface comprise a protuberance providing tactile identification, said protuberance upstanding from said surface and extending from said upper rim to said lower rim and providing tactile sensory stimulus distinguishable from said edges.

2. The magazine identifier band of claim 1, wherein the first ridge and the second ridge are substantially parallel relative to one another.

3. The magazine identifier band of claim 1, wherein the first ridge protrudes from the front surface extending from the upper rim and the second ridge protrudes from the front surface extending from the lower rim.

4. The magazine identifier band of claim 1, including a plurality of said protuberances.

5. The magazine identifier band of claim 1, wherein at least one of the first side surface and the second side surface is non-reflective.

6. The magazine identifier band of claim 1, wherein at least one of the first side surface and the second side surface is textured.

7. The magazine identifier band of claim 1, comprising a plurality of said magazine identifier bands, wherein each of said magazine identifier bands comprises a different color.

8. The magazine identifier band of claim 1, further comprising a writeable surface on at least one of the first side surface and the second side surface.

9. The magazine identifier band of claim 1, further comprising a means for securing said band to a thin panel.

10. A magazine identifier band system capturing a rifle ammunition magazine inserted therethrough, said magazine identifier band system comprising:

(a) a plurality of elastomeric magazine identifier bands, each conforming to the cross-sectional configuration of the rifle ammunition magazine and comprising a, front surface, a rear surface, a first side surface, a second side surface, an inner surface, an upper rim and a lower rim, wherein:

(b) a first ridge protrudes from the front surface upper rim and a second ridge protrudes from the front surface lower rim, together forming a finger groove in between; and (c) at least one of the first side surface and the second side surface comprise a protuberance providing tactile identification, said protuberance upstanding from said surface and extending from said upper rim to said lower rim and providing tactile sensory stimulus distinguishable from said edges.

11. The magazine identifier band system of claim 10, said first side surface comprising a protuberance and said second side surface comprising a like protuberance.

12. The magazine identifier band system of claim 11, said first side surface comprising a plurality of protuberances and said second side surface comprising the same plurality of like protuberances.

13. The magazine identifier band system of claim 10, said second side surface further comprising a writing area.

14. The magazine identifier band of claim 10, said first side surface further comprising a writeable surface.

15. The magazine identifier band of claim 14, wherein said writeable surface indicates a type of ammunition.

16. The magazine identifier band of claim 10, further comprising a means for securing said band to a thin panel.

17. The magazine identifier band of claim 16, wherein said means for securing said band to a thin panel comprises a belt clip.

18. A method of identifying a magazine comprising the steps of:

(a) providing an elastomeric magazine identifier band conforming to the cross-sectional configuration of the magazine and comprising a front surface, a rear surface, a first side surface, a second side surface, an inner surface, an upper rim and a lower rim, wherein a first ridge protrudes from the front surface upper rim and a second ridge protrudes from the front surface lower rim, together forming a finger groove in between;

(b) stretching the elastomeric magazine identifier band around the magazine; and (c) printing text on one of the first side surface and the second side surface, wherein the text comprises an ammunition type of the magazine.

19. The method of claim 18, at least one of the first side surface and the second side surface comprising a protuberance providing tactile identification.

20. The method of claim 19, said step of providing an elastomeric magazine identifier band comprising providing a plurality of said elastomeric magazine identifier bands, and said step of stretching the elastomeric magazine identifier band around the magazine comprising a user positioning each to accommodate a separate finger of the user in an arrangement preferred by the user.

* * * * *